US006302201B1

(12) United States Patent
Elliott

(10) Patent No.: US 6,302,201 B1
(45) Date of Patent: Oct. 16, 2001

(54) METHOD AND APPARATUS FOR WASHING SUBSEA DRILLING RIG EQUIPMENT AND RETRIEVING WEAR BUSHINGS

(76) Inventor: Gregory D. Elliott, 201 Waterside Dr., Lafayette, LA (US) 70503

( * ) Notice: Subject to any disclaimer, the term of this patent is extended or adjusted under 35 U.S.C. 154(b) by 0 days.

(21) Appl. No.: 09/030,090

(22) Filed: Feb. 25, 1998

(51) Int. Cl.[7] ..... E21B 37/00; E21B 37/02

(52) U.S. Cl. ..... 166/173; 166/170; 166/311; 15/104.05

(58) Field of Search ..... 166/170, 171, 166/172, 173, 176, 177.3, 311, 312; 15/104.05

(56) References Cited

U.S. PATENT DOCUMENTS

| | | | | |
|---|---|---|---|---|
| 2,602,515 | * | 7/1952 | Baker et al. | 166/173 |
| 2,661,024 | * | 12/1953 | Knox | 166/170 X |
| 2,695,673 | * | 11/1954 | Coyle | 166/170 |
| 2,882,019 | * | 4/1959 | Carr et al. | 166/170 X |
| 3,062,287 | * | 11/1962 | Hayes | 166/170 X |
| 3,116,800 | * | 1/1964 | Kammerer | 166/222 X |
| 3,251,306 | * | 5/1966 | Plunk | 166/170 X |
| 3,310,113 | * | 3/1967 | Maness | 166/173 |
| 3,720,264 | * | 3/1973 | Hutchison | 166/311 |
| 3,757,859 | * | 9/1973 | Hammon et al. | 166/173 |
| 3,811,499 | * | 5/1974 | Hutchison | 166/67 |
| 4,037,660 | * | 7/1977 | Newsom et al. | 166/302 |
| 4,441,557 | * | 4/1984 | Zublin | 166/312 |
| 5,033,545 | * | 7/1991 | Sudol | 166/105 X |
| 5,161,612 | * | 11/1992 | Stafford | 166/171 X |
| 5,564,500 | * | 10/1996 | Rogers et al. | 166/312 |
| 5,697,442 | * | 12/1997 | Baldridge | 166/312 X |

* cited by examiner

*Primary Examiner*—David Bagnell
*Assistant Examiner*—Jong-Suk Lee
(74) *Attorney, Agent, or Firm*—Ted M. Anthony

(57) ABSTRACT

A downhole tool for cleaning internal surfaces of subsea drilling rig equipment, including drilling risers, blowout preventor assemblies and wellhead assemblies, as well as for retrieving wear bushings, comprising an elongated support body, at least a pair of scraper blades and wash ports. A unique method of cleaning internal surfaces of subsea drilling rig equipment and retrieving a wear bushing in a single operation.

3 Claims, 1 Drawing Sheet

METHOD AND APPARATUS FOR WASHING SUBSEA DRILLING RIG EQUIPMENT AND RETRIEVING WEAR BUSHINGS

CROSS-REFERENCES TO RELATED APPLICATIONS

None

STATEMENT AS TO RIGHTS TO INVENTIONS MADE UNDER FEDERALLY SPONSORED RESEARCH AND DEVELOPMENT

None

BACKGROUND OF INVENTION

1. Field of the Invention

The invention disclosed herein is directed to methods and apparatus for cleaning or removing gelled drilling mud, well cuttings and other debris from the internal surfaces of equipment used during the drilling of offshore wells including, but not limited to, subsea blowout preventor assemblies, subsea wellheads and drilling risers. The invention disclosed herein is further directed to methods and apparatus for retrieving wear bushings seated within subsea wellheads. The invention disclosed herein is further directed to methods and apparatus for cleaning the internal surfaces of offshore drilling equipment, as well as the retrieving of wear bushings through the use of a single pipe trip.

2. Description of Related Art

Exploration for, and development of, offshore oil and gas reserves is typically an extremely expensive, high-risk venture. When a fixed platform is already in place, wells can be drilled using a platform-supported drilling rig. However, because of the high cost required to design, fabricate and install a platform and its associated production facilities, oil companies will typically defer this investment until the existence of sufficient oil and gas reserves to justify such an investment have been proved up through drilling operations. As a result, many offshore well are drilled using moveable rigs such as drill ships, semi-submersible rigs and jack-up rigs before a permanent platform is ever installed.

Drilling operations conducted from moveable drilling rigs such as drill ships, semi-submersible rigs and jack-up rigs differ from operations conducted from platform-supported drilling rigs in many respects. Among these differences is the location of the blowout preventor and wellhead assemblies. When drilling from drill ships, semi-submersible rigs and certain jack-up rigs, the blowout preventor and wellhead assemblies are not located on the rig, but rather on the sea floor; as a result, specialized equipment known as "subsea" blowout preventors and wellheads are utilized. A large diameter, flexible pipe known as a riser is used to connect the subsea assemblies to the offshore rig. During drilling operations, drill pipe and other downhole equipment is lowered from the rig through the riser, as well as through the subsea blowout preventor assembly and wellhead, and into the hole which is being drilled.

During drilling operations, including those conducted from moveable drilling rigs, drilling mud is typically pumped down the inside of the drill pipe and circulated up the annulus which is formed between the external surface of the drill pipe and the internal surface of the wellbore. The general functions of drilling mud are: (1) to cool and lubricate the drill bit and downhole equipment during drilling operations; (2) to transport rock cuttings and other debris from the bottom of the hole to the surface; (3) to suspend cuttings and debris during periods when circulation is stopped; (4) to provide hydrostatic pressure to control encountered subsurface pressures; and (5) to seal the hole with an impermeable filter cake. Drilling muds often contain various elements such as gelling agents (e.g. colloidal solids and/or emulsified liquids), weighing materials and chemicals necessary to control properties within desired limits. This drilling mud, as well as cuttings and other debris contained therein, often collect and accumulate on the inner surface of the riser, as well as the subsea blowout preventor assembly and wellhead. This build up of mud, cuttings and debris can significantly impede the drilling process, particularly when casing is being installed in the well.

During drilling operations, a desired length of hole is initially drilled. Thereafter, casing is installed and cemented in the hole. Additional hole is then drilled out of the bottom of the casing using a smaller diameter drill bit and bottom hole assembly. After a desired length of new hole is drilled, an additional string of casing is then installed and cemented in the well. In order to fit concentrically within the well, each successive casing string must be of smaller outer diameter than the inner diameter of the previous casing string which has been installed in the well. The bottom portion of each casing string is typically cemented in place, while the top end of each casing string is seated and secured within the wellhead assembly. When a casing string is seated or installed within a subsea wellhead assembly, it is generally advantageous that a pressure-tight seal is formed between the casing string and the wellhead assembly. In order to facilitate such a seal, the internal surface of the subsea wellhead often includes a polished bore receptacle which is designed to receive the casing string. Generally, very low tolerances exist between the casing and the internal surface of the wellhead assembly. As a result, the internal surface of the wellhead assembly, and particularly the polished bore receptacle, must be clean and relatively free from wear so that each successive casing string can be properly seated and sealed within the wellhead.

Further, the internal surfaces of the drilling riser and blowout preventors must also be relatively free of large amounts of drilling mud, well cuttings and other debris so that these materials are not pushed or scraped into the wellhead assembly when casing is being installed in the well. As each casing string is lowered into the well through the drilling riser, the casing can ride along the inner walls of the riser, and scrape mud and debris off the inner surface of the drilling riser and blowout preventor assemblies. If mud and debris build-up is not removed from the riser and blowout preventor assembly, it can often collect and accumulate at the wellhead, thereby preventing the casing from being properly received within the wellhead assembly.

Additionally, the drilling process itself can also cause wear on the internal surface of the wellhead, thereby damaging the inner profile of said wellhead and making it difficult for casing to be properly received within said wellhead. In order to prevent this wear, as well as the resultant damage that it can create, it is common to temporarily place a sacrificial wear bushing within the wellhead during drilling operations. As drill pipe is rotated and reciprocated in and out of the well, the wear bushing protects the inner surface of the wellhead from wear. Thereafter, once a desired length of hole has been drilled and casing is to be installed in the well, the wear bushing must be retrieved, exposing the inner surface of the wellhead which allows the casing to be seated within the wellhead assembly. Casing cannot be installed in the wellhead without the wear bushing being removed.

Drilling rigs are often "leased" for the length of time necessary to drill a well or wells, and paid for based on a daily rate; as such, the longer drilling operations take, the more expensive the project becomes. Accordingly, it is advantageous to save time and utilize efficient procedures. The tool of the present invention allows the rig operator to wash the drilling riser and subsea equipment, as well as remove the wear bushing, all in a single operation, thereby saving significant amounts of time and money.

The prior art contains numerous tools which utilize mechanical scraping action to clean internal wellbore surfaces, such as casing walls. Examples of such prior art includes U.S. Pat. Nos. 2,275,939; 2,575,307: 4,479,538; 4.809.793; 4,838,354; 4,979,566; 5,076,365; and 5,372,191. Additionally, the prior art contains numerous tools which utilize hydraulic means to clean internal wellbore surfaces, including casing walls. Examples of such prior art includes: U.S. Pat. No. 4,349,073; U.S. Pat. No. Re. 31,495; U.S. Pat. Nos. 4,441,557; 4,781,250; 5,348,086; and 5,564,500. Similarly, the prior art also contains numerous references which describe wear bushing retrieving tools, such as: U.S. Pat. Nos. 3,473,608; 3,645,328; 4,625,381; 4,995,458 and 5,199,495. However, the above references do not disclose an apparatus which can be utilized to clean subsea drilling equipment using both mechanical and hydraulic means, and which can also be utilized to retrieve wear bushings, all in a single pipe trip.

Thus, it is advantageous to have a means to clean and remove gelled drilling mud, well cuttings and other debris from the internal surfaces of drilling risers, subsea blowout preventers and subsea wellhead assemblies. Additionally, it is advantageous to have a means for cleaning said drilling risers, subsea blowout preventors and subsea wellhead assemblies, and further to retrieve wear bushings, through the use of a single pipe trip.

SUMMARY OF THE INVENTION

The present invention provides a method and apparatus for cleaning or removing gelled drilling mud, well cuttings and other debris from the internal surfaces of subsea blowout preventors, subsea wellheads and drilling risers, as well as the retrieval of wear bushings, all through use of a single pipe trip. The present invention meets the above described needs, and further overcomes the shortcomings of the prior art.

The wash tool of the present invention, which is generally cylindrical in shape, has a central tool body. Said tool body has upper and lower ends which are both adapted to be threadably connected to drill string or other downhole tool. The central tool body also has inner and outer surfaces. The inner surface of the tool body of the present invention defines a central longitudinal bore through said body which extends the entire length of said tool body.

A plurality of blades extend radially outward from the outer surface of said tool body. Said blades can be positioned at different locations along the outer periphery of said tool body. However, in the preferred embodiment of the present invention, the blades are all positioned the same vertical distance from the upper end of the tool body. As such, a plurality of said blades are positioned in a "cluster" at the same point along the length of said tool body. In said "cluster," said blades are equally phased around the circumference of said tool body; in the preferred embodiment of the present invention, a blade is positioned approximately every sixty (60°) degrees around the outer surface of said tool body.

The invention disclosed herein further contains a plurality of jet ports extending through said tool body for communicating the central longitudinal bore of said tool body with the wellbore to be cleaned. Although not specifically required, a jetting nozzle may be received in one or more of said jet ports. Said jet ports may be positioned at any location along the vertical length of said tool body. In the preferred embodiment of the present invention, at least one jet port is positioned at or near the center of each blade. Each such jet port which is positioned at a blade extends from the central longitudinal bore of said tool body and through said blade, thereby communicating said central longitudinal bore with the well annulus.

It is possible that said jet ports may be oriented in numerous different directions. However, in the preferred embodiment of the invention disclosed herein, a plurality of said jet ports are oriented in a direction perpendicular to the longitudinal axis of said tool body. Thus, in the preferred embodiment, said jet ports are directed radially outward from the central longitudinal bore of said tool body.

The lower end of the tool can be threadably connected to a brush tool. Additionally, a wear bushing retrieving tool can be connected to the invention at or near the base of said tool body. Several different wear bushing retrieving tools are known in the art. The configuration of said wear bushing retrieving tool utilized in connection with the present invention will depend on the specific type of wear bushing to be retrieved from a particular wellhead, which is often determined by the type and/or manufacturer of the wellhead being utilized.

The method of operating the apparatus involves connecting said apparatus to a drill string, and lowering said apparatus into a wellbore to be cleaned. Once said apparatus is positioned within said wellbore adjacent to the surfaces to be cleaned, said drill string can be reciprocated and rotated while pumping fluid down the pipe which exits the jets at high velocity. This results in the blades along the outer surface of the central tool body mechanically scraping the inner surfaces of the drilling riser, subsea blowout preventor and portions of the subsea wellhead, while fluid hydraulically scours said surfaces. The mechanical scraping and hydraulic jetting action caused by reciprocating and rotating said apparatus acts to remove gelled drilling mud, well cuttings and other debris from the surfaces to be cleaned.

Once said apparatus is positioned within the wellbore to be cleaned, drilling fluid can also be pumped or otherwise displaced down the drill string. Said fluid flows down the drill string, through the central longitudinal bore of the tool, out of the jet ports, and up the annulus of the wellbore. As the fluid exits said jet ports, said fluid is directed at the surfaces to be cleaned. Because the collective cross-sectional areas of said jet ports are significantly smaller than the cross-sectional area of the central longitudinal bore, particularly when jetting nozzles are received in said jet ports, the velocity of the fluid exiting the tool via said jet ports is significantly greater than the velocity of the fluid passing through the drill string. This high velocity fluid, which is directed at the inner surface of the wellbore, acts to scour said inner surface of the wellbore, and thereby removing gelled drilling mud, well cuttings and other debris from said surface. Once said drilling mud, well cuttings and other debris are removed, they cam be circulated up the wellbore annulus and out of the well.

During cleaning operations, the apparatus of the present invention may be lowered proximate to the wear bushing seated within the subsea wellhead assembly. Fluid exiting the base of the tool through the lower-most jet ports and the wear bushing retrieving tool jets will act to scour and clean debris from said wear bushing. If desired, the wear bushing can then be removed from the wellhead assembly using the wear bushing retrieving tool. Once the wear bushing has been removed from the wellhead, cleaning operations can continue, or the drill string and apparatus can be completely removed from the wellbore.

The apparatus and method of the present invention described herein allows for the subsea drilling equipment to be quickly and efficiently cleaned of gelled drilling mud, well cuttings and other debris. Although this operation can be performed at any stage of the drilling process, it is particularly important to clean the wellbore and retrieve the wear bushing prior to running casing in the well. Further, by allowing the wellbore to be cleaned and the wear bushing to be retrieved on a single pipe trip, valuable rig time can be saved.

DETAILED DESCRIPTION OF THE PREFERRED EMBODIMENT

Figure 1:
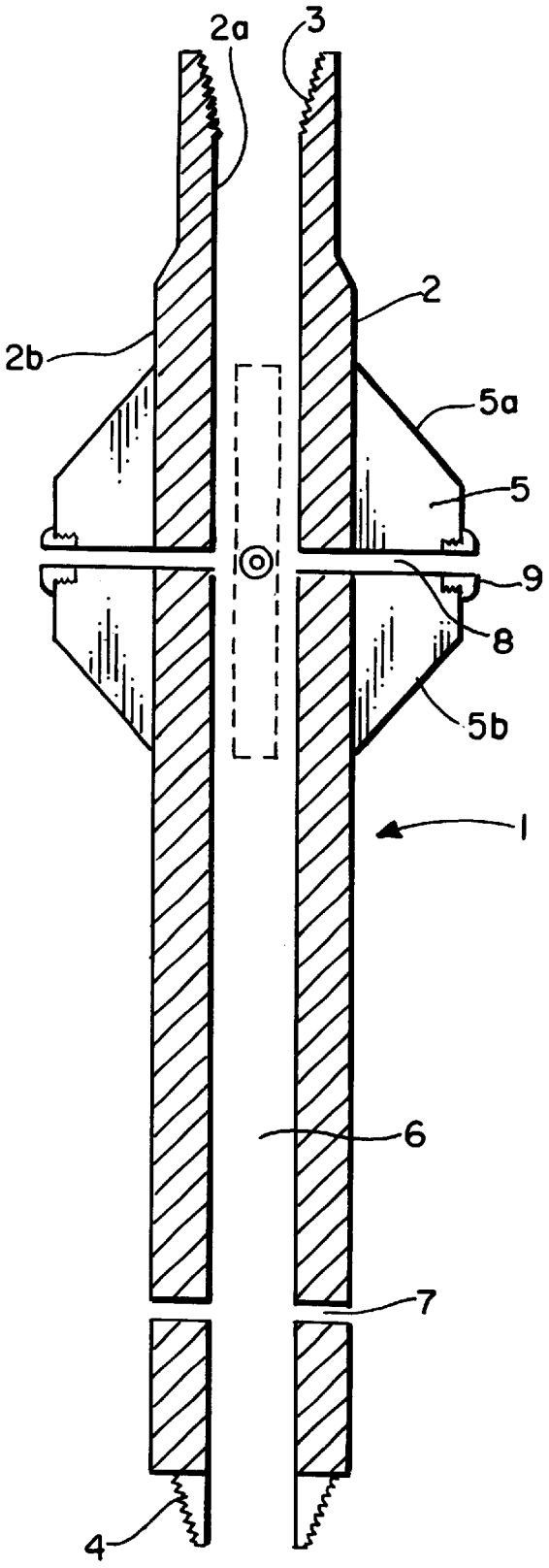
FIG. 1 shows a cross-section view of a preferred embodiment of the apparatus of the present invention.

Referring to the drawings, and more particularly to FIG. 1, the apparatus of the present invention is shown and generally referred to as numeral 1. The apparatus has generally cylindrical body 2, having inner surface 2*a* and outer surface 2*b*. The upper end of said body has threads 3, which are adapted to connect said body to a drill string. Similarly, the lower end of said body has threads 4, which are adapted to connect said body to a wear bushing retrieving tool, or other tool.

A plurality of blades 5 extend radially outward from the outer surface of body 2. Said blades, which are disposed parallel to the longitudinal axis of the cylindrical body, have upper beveled edges 5*a* and lower beveled edges 5*b*. In the preferred embodiment, said blades are positioned the same vertical distance from the upper end of said cylindrical body. Further, in the preferred embodiment, six blades are phased sixty (60°) degrees apart from one another around the outer circumference of said body.

Central body 2 further includes central bore 6 which is defined by inner surface 2*a* of central body 2. Central bore 6 has a longitudinal central axis which is identical to the central longitudinal axis of central body 2. Jet ports 7 extend radially outward from central bore 6, through central body 2. Similarly, jet ports 8 extend radially outward from central bore 5, through central body 2, and also through blades 5. Jet nozzles 9 can be installed in jet ports 7 and 8. A wear bushing retrieving tool can be affixed to central body 2 near the base of said central body.

In operation, the apparatus of the present invention is connected to the base of a drill string and lowered into a wellbore. Fluid is pumped or otherwise displaced down said drill string, and enters central body 2 through central bore 6. Said fluid continues, at high velocity, through jet ports 7 and 8, and through jet nozzles 9. As fluid exits said jet ports, it is directed radially outward towards the internal surface of the wellbore to be cleaned. Said fluid acts to scour the inner surface of the wellbore to be cleaned. Gelled drilling mud, drill cuttings and other debris loosened by said scouring action are then circulated with the fluid up the annulus between the outer surface of the drill string and the inner surface of the wellbore. Once a wellbore is sufficiently clean, a wear bushing can be retrieved from the subsea wellhead, and the entire apparatus can be removed from the wellbore.

Changes may be made in the combination and arrangement of elements as heretofore set forth in the specification and shown in the drawings; it being understood that changes may be made in the embodiments disclosed without departing from the spirit and scope of the invention as defined in the following claims:

What is claimed is:

1. A wash tool for cleaning subsea drilling equipment comprising:

a. an elongate tubular body having an upper end, a lower end and a central bore longitudinally disposed theretrough, wherein said central bore extends from said upper end to said lower end, and has a roughly constant diameter;

b. first connecting means at said upper end of said elongate tubular body;

c. second connecting means at said lower end of said elongate tubular body;

d. a plurality of elongate rigid members affixed to the peripheral surface of said elongate tubular body and extending radially outward from the peripheral surface of said elongate tubular body for scraping deposits from interior surfaces of subsea drilling equipment; and e. at least one wash port extending through said elongate tubular body and one of said elongate rigid members, communicating said central bore with the outer surface of said elongate rigid member.

2. A wash tool for cleaning subsea drilling equipment comprising:

a. an elongate tubular body having an upper end, a lower end and a central bore longitudinally disposed therethrough, wherein said central bore extends from said upper end to said lower end, and has a roughly constant diameter;

b. first connecting means at said upper end of said elongate tubular body;

c. second connecting means at said lower end of said elongate tubular body;

d. a plurality of circumferentially spaced elongate rigid blades extending radially outward from the peripheral surface of said elongate tubular body, wherein each of said elongate rigid blades defines an outer scraping edge for scraping deposits from interior surfaces of subsea drilling equipment; and e. at least one wash port extending through said elongate tubular body and one of said elongate rigid blades, communicating said central bore with the outer scraping edge of said elongate rigid blade.

3. A wash tool as recited in claim 2, wherein two or more circumferentially spaced blades having said wash ports extending therethrough are disposed at the same position along the longitudinal axis of said elongate tubular body.

* * * * *